US009829280B1

(12) United States Patent
Moore et al.

(10) Patent No.: US 9,829,280 B1
(45) Date of Patent: Nov. 28, 2017

(54) LASER ACTIVATED MOVING TARGET

(71) Applicants: Larry E. Moore, Cottonwood, AZ (US); Aaron Moore, Cottonwood, AZ (US)

(72) Inventors: Larry E. Moore, Cottonwood, AZ (US); Aaron Moore, Cottonwood, AZ (US)

( * ) Notice: Subject to any disclaimer, the term of this patent is extended or adjusted under 35 U.S.C. 154(b) by 0 days.

(21) Appl. No.: 15/166,145

(22) Filed: May 26, 2016

(51) Int. Cl.

| | |
|---|---|
| ***F41J 5/02*** | (2006.01) |
| ***F41G 3/26*** | (2006.01) |
| ***F41J 5/18*** | (2006.01) |
| *F41J 5/08* | (2006.01) |

(52) U.S. Cl.
CPC ..... *F41G 3/2655* (2013.01); *F41J 5/18* (2013.01); *F41J 5/02* (2013.01); *F41J 5/08* (2013.01)

(58) Field of Classification Search
CPC .... F41J 5/02; F41J 5/08; F41G 3/2655; F41A 33/02
USPC ..... 273/371–377; 463/5
See application file for complete search history.

(56) References Cited

U.S. PATENT DOCUMENTS

| | | | |
|---|---|---|---|
| 1,898,566 | A | 2/1933 | Noel |
| 2,268,056 | A | 12/1941 | Nelson et al. |
| 2,357,951 | A | 9/1944 | Hale |
| 2,430,469 | A | 11/1947 | Karnes |
| 2,597,565 | A | 5/1952 | Chandler et al. |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Rudolf |
| 2,904,888 | A | 9/1959 | Niesp |
| 3,104,478 | A | 9/1963 | Strauss |
| 3,112,567 | A | 12/1963 | Flanagan |
| 3,192,915 | A | 7/1965 | Norris et al. |
| 3,284,905 | A | 11/1966 | Simmons |
| 3,510,965 | A | 5/1970 | Rhea |
| 3,526,972 | A | 9/1970 | Sumpf |
| 3,573,868 | A | 4/1971 | Giannetti |
| 3,618,673 | A | 11/1971 | Gossett |
| 3,633,285 | A | 1/1972 | Sensney |
| 3,641,676 | A | 2/1972 | Knutsen et al. |

(Continued)

FOREIGN PATENT DOCUMENTS

| | | |
|---|---|---|
| BE | 1009564 | 5/1997 |
| EP | 1046877 EP | 10/2000 |
| FR | 862247 | 3/1941 |

OTHER PUBLICATIONS

EPO; Office Action dated Oct. 5, 2011 in U.S. Appl. No. 09/169,459.

(Continued)

*Primary Examiner* — Mark Graham
(74) *Attorney, Agent, or Firm* — Snell & Wilmer LLP

(57) ABSTRACT

A laser targeting apparatus rests on a surface and moves, such as by vibrating, wobbling, or shaking, when struck by laser light of sufficient intensity. The apparatus is designed not to fall over, so a user does not have to move to the apparatus and pick it up after a strike. The apparatus has a body that includes a structure, which is preferably one or more printed circuit boards including light sensors, for detecting strikes of laser light, and a motor. When a strike of laser light is detected, power is provided to the motor, which vibrates and causes the apparatus to move.

20 Claims, 3 Drawing Sheets

(56) References Cited

U.S. PATENT DOCUMENTS 3,645,635 A 2/1972 Steck
3,748,751 A 7/1973 Breglia
3,801,205 A 4/1974 Eggenschwyler
3,813,795 A 6/1974 Marshall
3,914,873 A 10/1975 Elliott, Jr. et al.
3,948,522 A 4/1976 Fixler
3,992,783 A 11/1976 Dunlap et al.
3,995,376 A 12/1976 Kimble et al.
4,026,054 A 5/1977 Snyder
4,048,489 A 9/1977 Giannetti
4,063,368 A 12/1977 McFarland
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,348,828 A 9/1982 Snyder
4,352,665 A 10/1982 Kimble et al.
4,452,458 A 6/1984 Timander
4,481,561 A 11/1984 Lanning
4,487,583 A * 12/1984 Brucker ..... F41G 3/2655 434/22
4,488,369 A 12/1984 Van Note
4,541,191 A 9/1985 Morris et al.
4,567,810 A 2/1986 Preston
4,662,845 A * 5/1987 Gallagher ..... F41J 7/04 273/372
4,713,889 A 12/1987 Santiago
4,763,431 A 8/1988 Allan et al.
4,825,258 A 4/1989 Whitson
4,830,617 A 5/1989 Hancox et al.
4,860,775 A 8/1989 Reeves
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,177,309 A 1/1993 Willoughby et al.
5,178,265 A 1/1993 Sepke
5,179,124 A 1/1993 Schoenwald et al.
5,179,235 A 1/1993 Toole
5,194,007 A 3/1993 Marshall
5,208,826 A 5/1993 Kelly
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,481,819 A 1/1996 Teetzel
5,488,795 A 2/1996 Sweat
D368,121 S 3/1996 Lam
5,499,455 A 3/1996 Palmer
5,509,226 A 4/1996 Houde-Walter
5,515,636 A 5/1996 McGarry et al.
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,605,461 A 2/1997 Seeton
5,618,099 A 4/1997 Brubacher
5,621,999 A 4/1997 Moore
5,622,000 A 4/1997 Marlowe
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,716,216 A * 2/1998 O'Loughlin ..... F41J 5/02 273/365
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,282,829 B1 9/2001 Mossberg et al.
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,345,464 B1 2/2002 Kim et al.
6,363,648 B1 4/2002 Kranich et al.
6,366,349 B1 4/2002 Houde-Walter
6,371,004 B1 4/2002 Peterson
6,385,893 B1 5/2002 Cheng
6,389,729 B2 5/2002 Rauch et al.
6,389,730 B1 5/2002 Millard
6,397,509 B1 6/2002 Langner
6,430,861 B1 8/2002 Ayers et al.
6,434,874 B1 8/2002 Hines

(56) References Cited

U.S. PATENT DOCUMENTS 6,442,880 B1 9/2002 Allan
6,487,807 B1 12/2002 Kopman et al.
6,499,247 B1 12/2002 Peterson
6,526,688 B1 3/2003 Danielson et al.
6,568,118 B1 5/2003 Teetzel
6,572,375 B2 6/2003 Shechter et al.
6,575,753 B2 6/2003 Rosa et al.
6,578,311 B2 6/2003 Danielson et al.
6,579,098 B2 6/2003 Shechter et al.
6,591,536 B2 7/2003 Houde-Walter et al.
6,606,797 B1 8/2003 Gandy
6,614,510 B1 9/2003 Rogers et al.
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
D487,791 S 3/2004 Freed
6,742,299 B2 6/2004 Strand
6,749,075 B2 6/2004 Bourque
6,782,789 B2 8/2004 McNulty
6,804,907 B1 10/2004 Slobodkin
6,843,478 B1 * 1/2005 Hoepelman ..... A63B 63/00 273/342
6,854,205 B2 2/2005 Wikle et al.
6,860,053 B2 3/2005 Christiansen
6,931,775 B2 8/2005 Burnett
6,935,864 B2 8/2005 Shechter et al.
6,945,782 B2 * 9/2005 Isoz ..... F41G 3/2655 434/11
6,966,775 B1 11/2005 Kendir et al.
7,032,342 B2 4/2006 Pikielny
7,049,575 B2 5/2006 Hotelling
7,111,424 B1 9/2006 Moody et al.
7,117,624 B2 10/2006 Kim
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,325,352 B2 2/2008 Matthews et al.
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
7,387,052 B2 6/2008 Chang
RE40,429 E 7/2008 Oliver et al.
D578,599 S 10/2008 Cheng
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,505,119 B2 3/2009 Rogers et al.
7,578,089 B1 8/2009 Griffin
7,584,569 B2 9/2009 Kallio
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,827,726 B2 11/2010 Stokes
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,001,715 B2 8/2011 Stokes
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,100,694 B2 1/2012 Portoghese
8,104,220 B2 1/2012 Cobb
D653,798 S 2/2012 Janice et al.
8,109,024 B2 2/2012 Abst
8,110,760 B2 2/2012 Sharrah et al.
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,151,504 B1 4/2012 Aiston
8,151,505 B2 4/2012 Thompson
8,166,694 B2 5/2012 Swan
8,172,139 B1 5/2012 McDonald et al.
D661,366 S 6/2012 Zusman
8,196,328 B2 6/2012 Simpkins
8,215,047 B2 7/2012 Ash et al.
8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman

(56) References Cited

U.S. PATENT DOCUMENTS 8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,464,451 B2 6/2013 McRae
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
8,607,495 B2 12/2013 Moore et al.
D697,162 S 1/2014 Faifer
D697,163 S 1/2014 Bietsch
8,661,725 B1 3/2014 Ganther et al.
8,662,694 B1 3/2014 Izumi et al.
8,734,156 B2 5/2014 Uhr
8,739,447 B2 6/2014 Merritt et al.
D709,585 S 7/2014 Klecker
D710,966 S 8/2014 Barfoot
8,807,779 B1 8/2014 Izumi et al.
8,813,411 B2 8/2014 Moore et al.
8,844,189 B2 9/2014 Moore et al.
D720,423 S 12/2014 Barfoot
8,919,023 B2 12/2014 Merritt et al.
8,927,083 B2 1/2015 Pell
8,938,904 B1 1/2015 Sellers et al.
D722,125 S 2/2015 Zayatz
8,944,838 B2 2/2015 Mulfinger
9,023,459 B2 5/2015 Hogue
9,146,077 B2 9/2015 Moore
9,182,194 B2 11/2015 Moore
9,188,407 B2 11/2015 Moore et al.
9,272,402 B2 3/2016 Hu
9,297,614 B2 3/2016 Moore
9,644,826 B2 5/2017 Moore et al.
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0129536 A1 9/2002 Iafrate et al.
2002/0134000 A1 9/2002 Varshneya et al.
2002/0194767 A1 12/2002 Houde-Walter et al.
2003/0003424 A1 1/2003 Shechter et al.
2003/0029072 A1 2/2003 Danielson
2003/0175661 A1 9/2003 Shechter et al.
2003/0180692 A1 9/2003 Skala et al.
2003/0196366 A1 10/2003 Beretta
2004/0003529 A1 1/2004 Danielson
2004/0010956 A1 1/2004 Bubits
2004/0014010 A1 1/2004 Swensen et al.
2004/0064994 A1 4/2004 Luke
2005/0044736 A1 3/2005 Liao
2005/0130739 A1 6/2005 Argentar
2005/0153262 A1 7/2005 Kendir
2005/0185403 A1 8/2005 Diehl
2005/0188588 A1 9/2005 Keng
2005/0241209 A1 11/2005 Staley
2005/0257415 A1 11/2005 Solinsky et al.
2005/0268519 A1 12/2005 Pikielny
2006/0162225 A1 7/2006 Danielson
2006/0191183 A1 8/2006 Griffin
2007/0039226 A1 2/2007 Stokes
2007/0041418 A1 2/2007 Laughman et al.
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky et al.
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1* 2/2009 Jones ..... F41A 33/02 434/22
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.
2010/0175297 A1 7/2010 Speroni
2010/0229448 A1 9/2010 Houde-Walter
2010/0275496 A1 11/2010 Solinsky et al.
2011/0047850 A1 3/2011 Rievley et al.
2011/0061283 A1 3/2011 Cavallo
2011/0074303 A1 3/2011 Stokes
2011/0119868 A1 5/2011 LaLonde
2011/0162249 A1 7/2011 Woodmansee et al.
2011/0185619 A1 8/2011 Finnegan et al.
2012/0005938 A1 1/2012 Sloan
2012/0047787 A1 3/2012 Curry
2012/0055061 A1 3/2012 Hartley et al.
2012/0110886 A1 5/2012 Moore et al.
2012/0124885 A1 5/2012 Caulk et al.
2012/0144716 A1 6/2012 Cabahug et al.
2012/0180366 A1 7/2012 Jaroh et al.
2012/0180367 A1 7/2012 Singh
2012/0180370 A1 7/2012 McKinley
2012/0224357 A1 9/2012 Moore
2013/0185978 A1 7/2013 Dodd et al.
2013/0185982 A1 7/2013 Hilbourne et al.
2013/0205635 A1 8/2013 Hines
2013/0263492 A1 10/2013 Erdle
2013/0318851 A1 12/2013 Diamond
2014/0007485 A1 1/2014 Castejon
2014/0109457 A1 4/2014 Speroni
2014/0355258 A1 12/2014 Izumi et al.
2015/0283459 A1* 10/2015 Condon ..... A63H 30/04 463/5
2015/0308670 A1 10/2015 Moore
2015/0345905 A1 12/2015 Hancosky
2015/0348330 A1* 12/2015 Balachandreswaran A63F 13/00 463/5
2016/0059136 A1* 3/2016 Ferris ..... F41A 33/02 463/5
2016/0084618 A1* 3/2016 Hong ..... F41J 5/14 273/371
2016/0091285 A1* 3/2016 Mason ..... F41J 5/04 273/372
2016/0161220 A1 6/2016 Moore
2016/0245617 A1 8/2016 Moore
2016/0305748 A1 10/2016 Moore
2016/0361626 A1 12/2016 Moore
2017/0003103 A1 1/2017 Moore
2017/0082399 A1 3/2017 Moore
2017/0153095 A1 6/2017 Moore
2017/0160054 A1 6/2017 Moore

OTHER PUBLICATIONS

EPO; Office Action dated Oct. 5, 2011 in U.S. Appl. No. 09/169,469.
EPO; Office Action dated Dec. 20, 2011 in U.S. Appl. No. 09/169,476.
EPO; Office Action dated Sep. 3, 2012 in U.S. Appl. No. 09/169,469.

(56) References Cited

OTHER PUBLICATIONS

EPO; Office Action dated Sep. 3, 2012 in U.S. Appl. No. 09/169,476.
EPO; Office Action dated Sep. 3, 2012 in U.S. Appl. No. 09/169,459.
EPO; Search Opinion and Report dated Aug. 6, 2010 in U.S. Appl. No. 09/169,459.
EPO; Search Opinion and Report dated Aug. 6, 2010 in U.S. Appl. No. 09/694,69.
EPO; Search Opinion and Report dated Aug. 23, 2010 in U.S. Appl. No. 09/169,476.
EPO; Search Report and Opinion dated Aug. 6, 2012 in U.S. Appl. No. 11/151,504.
U.S. Advisory Action dated Aug. 22, 2011 in U.S. Appl. No. 12/249,781.
U.S. Advisory Action dated Jul. 13, 2012 in U.S. Appl. No. 12/249,781.
U.S. Final Office Action dated Feb. 24, 2010 in U.S. Appl. No. 11/317,647.
U.S. Final Office Action dated Mar. 6, 2012 in U.S. Appl. No. 12/610,213.
U.S. Final Office Action dated May 2, 2012 in U.S. Appl. No. 12/249,781.
U.S. Final Office Action dated Jun. 19, 2009 in U.S. Appl. No. 11/317,647.
U.S. Final Office Action dated May 18, 2011 in U.S. Appl. No. 12/249,781.
U.S. Final Office Action dated Aug. 7, 2012 in U.S. Appl. No. 12/249,781.
U.S. Notice of Allowance dated Feb. 2, 2011 in U.S. Appl. No. 12/249,794.
U.S. Notice of Allowance dated Feb. 26, 2002 in U.S. Appl. No. 09/624,124.
U.S. Notice of Allowance dated Mar. 3, 2011 in U.S. Appl. No. 12/249,785.
U.S. Notice of Allowance dated May 13, 2011 in U.S. Appl. No. 12/249,785.
U.S. Notice of Allowance dated May 17, 2011 in U.S. Appl. No. 13/077,861.
U.S. Notice of Allowance dated Jul. 8, 2011 in U.S. Appl. No. 12/249,794.
U.S. Notice of Allowance dated Sep. 1, 2011 in U.S. Appl. No. 13/077,861.
U.S. Notice of Allowance dated Nov. 1, 2011 in U.S. Appl. No. 13/077,875.
U.S. Notice of Allowance dated Nov. 18, 2011 in U.S. Appl. No. 13/077,861.
U.S. Notice of Allowance dated Jul. 25, 2012 in U.S. Appl. No. 12/610,213.
U.S. Notice of Allowance dated Aug. 16, 2012 in U.S. Appl. No. 13/346,621.
U.S. Office Action dated Jan. 26, 2012 in U.S. Appl. No. 12/249,781.
U.S. Office Action dated Sep. 28, 2009 in U.S. Appl. No. 11/317,647.
U.S. Office Action dated Oct. 6, 2010 in U.S. Appl. No. 12/249,794.
U.S. Office Action dated Oct. 18, 2011 in U.S. Appl. No. 12/610,213.
U.S. Office Action dated Nov. 8, 2010 in U.S. Appl. No. 12/249,781.
U.S. Office Action dated Dec. 26, 2008 in U.S. Appl. No. 11/317,647.
U.S. Office Action dated Jun. 11, 2001 in U.S. Appl. No. 09/624,124.
U.S. Office Action dated Jun. 22, 2011 in U.S. Appl. No. 13/077,875.
U.S. Office Action dated Nov. 15, 2012 in U.S. Appl. No. 13/412,385.
U.S. Office Action dated Feb. 1, 2013 in U.S. Appl. No. 12/249,781.
U.S. Office Action dated Feb. 20, 2013 in U.S. Appl. No. 13/670,278.
U.S. Office Action dated Mar. 26, 2013 in U.S. Appl. No. 13/353,241.
U.S. Final Office Action dated Sep. 24, 2013 in U.S. Appl. No. 13/353,241.
U.S. Office Action dated Jan. 31, 2014 in U.S. Appl. No. 13/353,241.
U.S. Final Office Action dated Sep. 10, 2014 in U.S. Appl. No. 13/353,241.
U.S. Office Action dated Oct. 23, 2012 in U.S. Appl. No. 13/010,649.
U.S. Final Office Action dated Apr. 11, 2013 in U.S. Appl. No. 13/010,649.
U.S. Final Office Action dated May 16, 2013 in U.S. Appl. No. 13/412,385.
U.S. Office Action dated Jun. 17, 2013 in U.S. Appl. No. 13/353,301.
U.S. Notice of Allowance dated Jan. 18, 2012 in U.S. Appl. No. 13/353,301.
U.S. Office Action dated Jun. 19, 2013 in U.S. Appl. No. 13/353,165.
U.S. Final Office Action dated Jul. 29, 2014 in U.S. Appl. No. 13/353,165.
U.S. Office Action dated Nov. 20, 2014 in U.S. Appl. No. 13/353,165.
U.S. Notice of Allowance dated Jun. 5, 2015 in U.S. Appl. No. 13/353,165.
U.S. Notice of Allowance dated Jul. 24, 2015 in U.S. Appl. No. 13/353,165.
U.S. Final Office Action dated Jun. 24, 2013 in U.S. Appl. No. 13/670,278.
U.S. Office Action dated Dec. 11, 2013 in U.S. Appl. No. 13/670,278.
U.S. Notice of Allowance dated Apr. 25, 2014 in U.S. Appl. No. 13/670,278.
U.S. Notice of Allowance dated Jul. 15, 2013 in U.S. Appl. No. 13/412,385.
U.S. Office Action dated Nov. 4, 2013 in U.S. Appl. No. 13/412,385.
U.S. Final Office Action dated Mar. 27, 2014 in U.S. Appl. No. 13/412,385.
U.S. Office Action dated Sep. 30, 2014 in U.S. Appl. No. 13/412,385.
U.S. Notice of Allowance dated Aug. 6, 2013 in U.S. Appl. No. 13/010,649.
U.S. Notice of Allowance dated Jul. 22, 2013 in U.S. Appl. No. 12/249,781.
U.S. Decision on Appeal dated Aug. 20, 2013 in U.S. Appl. No. 11/317,647.
U.S. Office Action dated Jan. 27, 2014 in U.S. Appl. No. 13/707,312.
U.S. Notice of Allowance dated Jun. 11, 2014 in U.S. Appl. No. 13/707,312.
U.S. Notice of Allowance dated Jul. 7, 2015 in U.S. Appl. No. 14/182,140.
U.S. Office Action dated Aug. 19, 2014 in U.S. Appl. No. 14/316,688.
U.S. Final Office Action dated Jan. 27, 2015 in U.S. Appl. No. 14/316,688.
U.S. Notice of Allowance dated Jun. 24, 2015 in U.S. Appl. No. 14/316,688.
U.S. Office Action dated Mar. 3, 2015 in U.S. Appl. No. 14/278,315.
U.S. Notice of Allowance dated Jun. 24, 2015 in U.S. Appl. No. 14/278,315.
U.S. Office Action dated Jul. 2, 2015 in U.S. Appl. No. 14/459,274.
U.S. Notice of Allowance dated Nov. 24, 2015 in U.S. Appl. No. 14/459,274.
U.S. Notice of Allowance dated Nov. 15, 2016 in U.S. Appl. No. 14/630,467.
Webpage print out from http://airgunexpress.com/Accessories/ referencing various level devices.
Webpage print out from http://secure.armorholdings.com/b-square/smarthtml/about.html referencing background on B-Square and their firearm accessories.

(56) References Cited

OTHER PUBLICATIONS

Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.
U.S. Notice of Allowance dated Mar. 7, 2017 in U.S. Appl. No. 14/630,467.
U.S. Non-Final Office Action dated Aug. 30, 2016 in U.S. Appl. No. 14/955,440.
U.S. Non-Final Office Action dated Oct. 6, 2016 in U.S. Appl. No. 15/243,813.
U.S. Notice of Allowance dated Apr. 26, 2017 in U.S. Appl. No. 15/130,744.
U.S. Final Office Action dated May 18, 2017 in U.S. Appl. No. 15/243,813.
U.S. Non-Final Office Action dated Jun. 2, 2017 in U.S. Appl. No. 14/963,475.
U.S. Requirement for Restriction dated Jun. 5, 2017 in U.S. Appl. No. 14/863,304.
USPTO; Notice of Allowance and Fees Due dated Jul. 11, 2017 in U.S. Appl. No. 15/130,744.
USPTO; Non-Final Office Action dated Aug. 24, 2017 in U.S. Appl. No. 15/253,543.

* cited by examiner

LASER ACTIVATED MOVING TARGET

FIELD OF THE INVENTION

The present invention is related to targets that detect strikes of laser light, rather than targets that are struck with projectiles such as bullets.

SUMMARY OF THE INVENTION

A laser targeting apparatus rests on a surface and moves, such as by vibrating or shaking, when struck at certain locations by laser light. The apparatus is designed not to fall over, so a user does not have to move to the apparatus and pick it up after a laser light strike. The apparatus has a body that houses a laser light detector, which is preferably one or more printed circuit boards, for detecting strikes of laser light, and a motor. The apparatus is typically used for aiming or sighting purposes with a gun that fires laser light instead of projectiles. This is often accomplished by using a standard gun with a laser light trainer cartridge, which is known to those in the art. When a strike of laser light is detected, power is provided to the motor, which causes the motor to vibrate and in turn causes the apparatus to move.

DETAILED DESCRIPTION OF PREFERRED EMBODIMENTS

Figure 1:
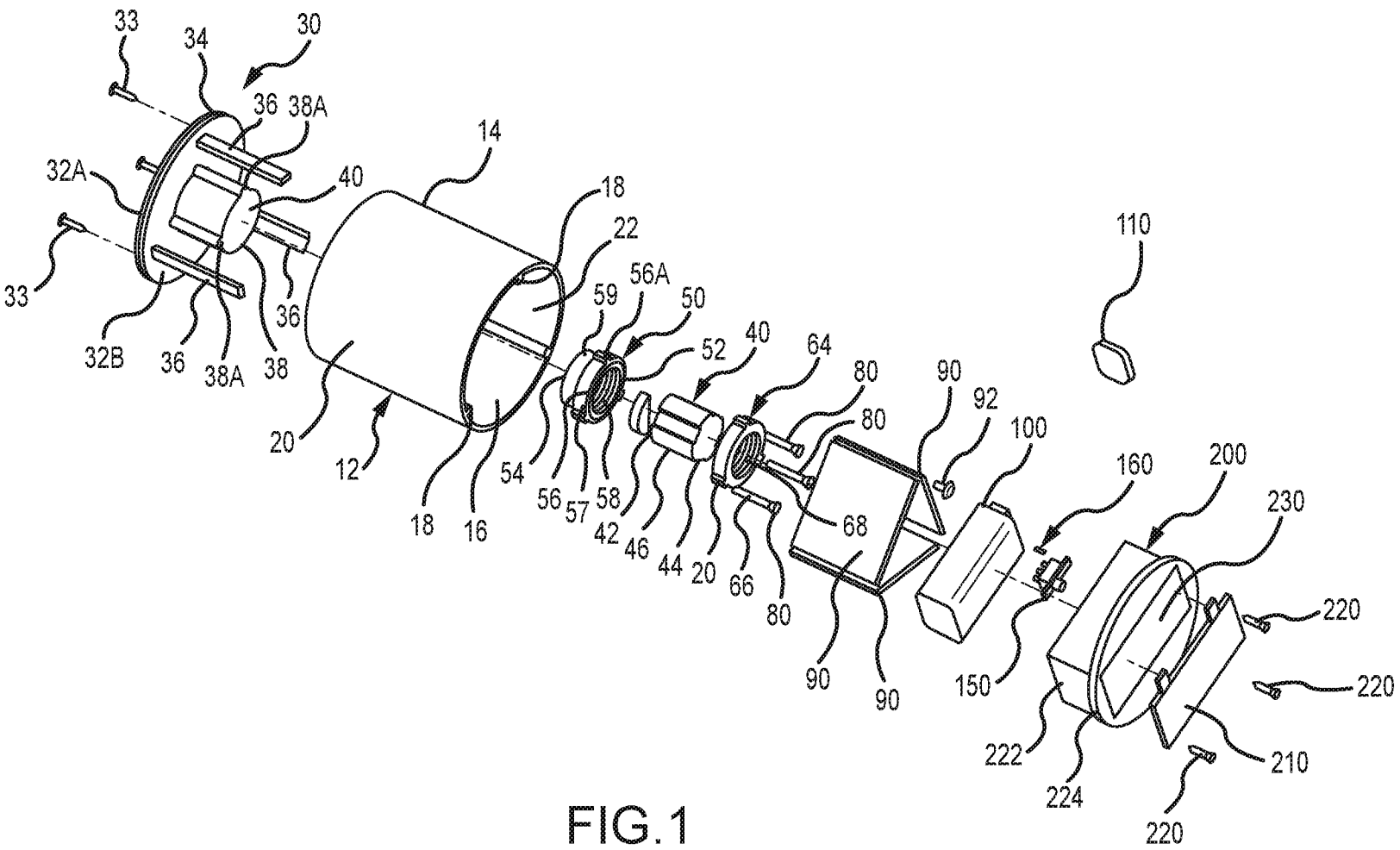
FIG. 1 is an exploded view of an apparatus in accordance with aspects of the invention.

Turning now to the drawings, where the purpose is to describe preferred embodiments of the invention and not to limit same, FIG. 1 shows an exploded view of a preferred embodiment of the invention. Apparatus 10 has a housing 12 with an annular outer surface 14, an annular inner surface 16, and three fastener retention grooves 18 that, as shown, are equally, radially spaced along inner surface 16. Housing 12 may, however, be of any suitable shape or size. Housing 12 is preferably clear (or translucent and colored red, which helps filter ambient light, but permits red laser light to pass through), so that red laser light can pass through it and be detected. Housing 12 has a top opening 20 and a bottom opening 22.

A top cap, or top, 30 functions to seal top opening 20 and to retain a portion of a motor sleeve. Top cap 30 has a flat, sealing portion 32 that has an upper surface 32A and a lower surface 32B. Top cap 30 includes three apertures 34 that align with fastener retention grooves 18 when placed on top opening 20 of housing 12. When assembled, fasteners 33 pass through apertures 34 and are retained in grooves 18 to attach top cap 30 to housing 12.

Top cap 30 includes three downwardly-extending prongs 36 that fit inside of housing 12 and fit inside of a space between printed circuit boards 90 to help to support them. Top 30 also includes a downward-extending retainer 38 that has a cavity 40 for receiving part of the motor sleeve in a preferred embodiment, as discussed below.

Motor 40 is a known type of vibrating motor, or wobble motor. Motor 40 has a first end 42, a second end 44, and body portion 46. A motor sleeve 50 is made of elastomeric material and is preferably comprised of soft or semi-rigid rubber or plastic. Sleeve 50 has a first end 52, a second end 54, a body 56 and an opening 58 therethrough. Body 56 has a first portion 57 with a first diameter and a second portion 59 with a second diameter, wherein the second diameter is less than the first diameter. Extensions 56A are positioned on and extend outward from first portion 57, and have apertures 56B for receiving fasteners 80.

Motor cap 64 is preferably comprised of a soft or semi-rigid plastic or rubber. Motor cap 64 as shown has an annular body 66 and an opening 68 extending therethrough. Extensions 70 are positioned on and extend outward from body 66. Each extension 70 has an aperture 70A for receiving a fastener 80.

When assembled, end 42 and at least some of body portion 46 of motor 40 are received in opening 58, and retained in sleeve 50. Cap 64 is pressed against end 44 of motor 40 and fasteners 80 pass through apertures 70A, 56B, and are received in apertures 38A to create a motor assembly that is connected to retainer 38 of top 30. Second portion 59 of sleeve 56 is then retained in cavity 40 to provide lateral support to the motor assembly, and to help transfer vibration of motor 40 to top cap 30 and body 12.

Printed circuit boards 90 include light sensors that detect strikes of laser light. In this embodiment, there are three printed circuit boards arranged in a triangular fashion, and they may be connected by fasteners 92. In this embodiment, at least part of motor 40 and sleeve 50 are positioned in the space between printed circuit boards 90 when apparatus 10 is assembled. Although three circuit boards arranged in a triangular shape are shown, any suitable member, type, or shape of printed circuit boards may be utilized. Also, any one or more devices may be utilized in place of printed circuit boards 90, wherein the one or more devices detect laser light strikes and cause power to flow to motor 40, thereby activating motor 40, as a result. As shown, each printed circuit board is planar and rectangular with four sides.

A bottom, or bottom cap, 200 retains a power source 100, which is preferably a 9V battery, but can be any suitable battery(ies) or other power source. Apparatus 10 may also utilize electric power accessed through an outlet via a wired connection. A battery attachment 110 attaches to the negative and positive posts of the 9V battery in this embodiment, in order to transfer power from the battery. In this preferred embodiment, cap 200 also retains a switch 150 that switches power on or off from power source 100 and that is retained in bottom cap 200 by fasteners 160.

Bottom 200 has a first portion 222, which as shown is rectangular, and a second portion 224, which as shown is circular and seals the bottom of body 12 when apparatus 10 is fully assembled.

Bottom 200 has a battery door 210 that is retained on the bottom side of bottom 200 by fasteners 220, and can be removed to replace power source 100, which is positioned in cavity 230.

Figure 2:
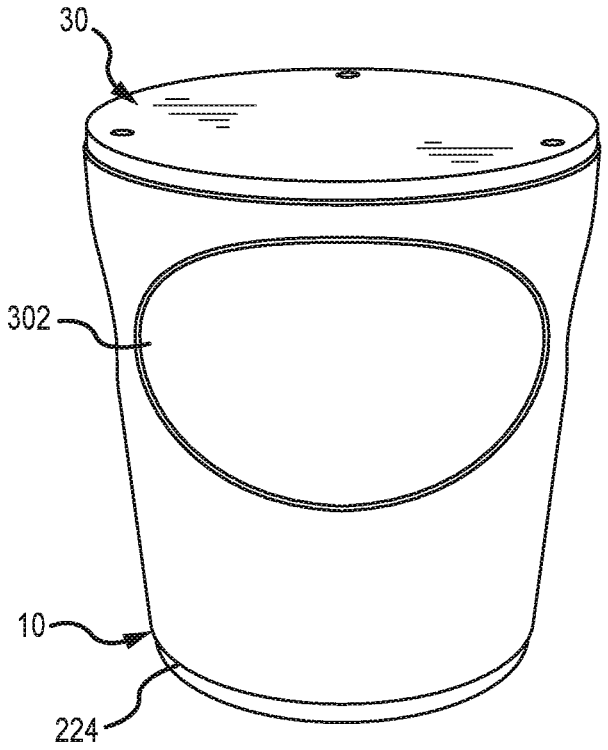
FIG. 2 is an assembled, side perspective view of the apparatus of FIG. 1 with a covering over part of the outer surface of the body.
Figure 3:
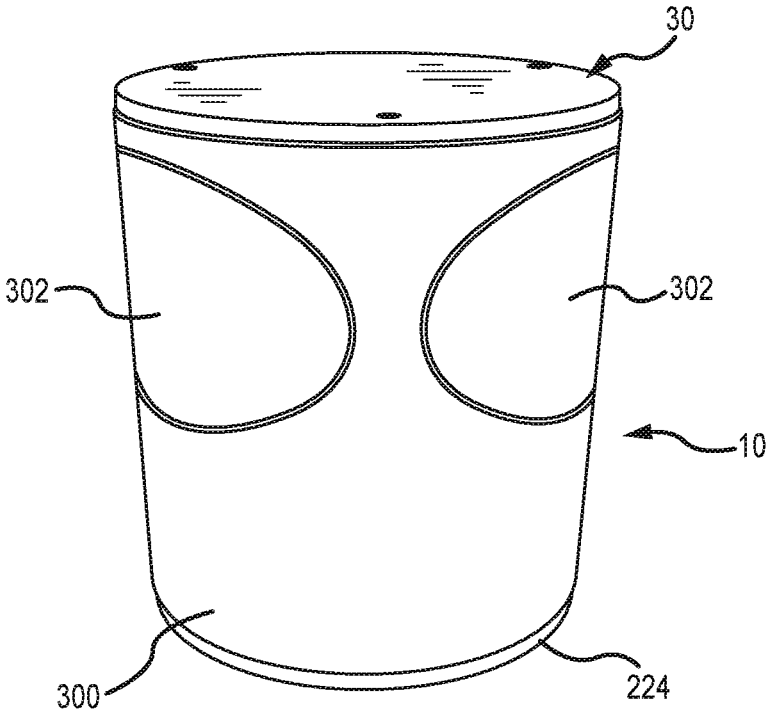
FIG. 3 is a different, assembled, side view of the apparatus of FIG. 2.

Turning now to FIGS. 2 and 3, apparatus 10 is shown assembled, with an outer adhesive coating 300 on outer surface 20 of body 12 to define elliptical areas.

When laser light of sufficient intensity strikes one of the areas 302, it passes through body 20 and strikes one of the printed circuit boards 90. A light sensor on the printed circuit board 90 that is struck causes the printed circuit board 90 to activate circuit 150 and cause power to flow from power source 100 through the printed circuit board 90 that was struck with laser light to motor 40. Motor 40 then vibrates, preferably for a period of 3-5 seconds. The vibration of motor 40 is transferred to body 12 of apparatus 10 as previously described, causing apparatus 10 to vibrate or wobble without falling over.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. An apparatus for detecting a strike of laser light, the apparatus comprising:

(a) a body having an outer surface, at least a portion of which that permits laser light to pass through, a top and a bottom;

(b) one or more printed circuit boards with light sensors inside of the outer surface, wherein each printed circuit board is configured to detect a laser light strike;

(c) a power source;

(d) a motor;

(e) an opening at the top of the body and an opening at the bottom of the body;

(f) a top cap that covers the top of the body; and (g) the top cap has a downwardly extending retainer and the apparatus further includes a motor sleeve, wherein the motor sleeve is at least partially received in the retainer, such that when the motor vibrates, vibration is transferred to the retainer, the top cap, and to the body;

wherein when the printed circuit board detects a laser light strike, power is transferred from the power source to the motor thereby activating the motor, and the motor vibrates causing the apparatus to vibrate.

2. The apparatus of claim 1 wherein the outer surface is cylindrical.

3. The apparatus of claim 1 wherein the outer surface is plastic.

4. The apparatus of claim 1 wherein the outer surface is translucent and colored red.

5. The apparatus of claim 1 that has a plurality of printed circuit boards.

6. The apparatus of claim 1 wherein there are three printed circuit boards arranged in a triangular pattern.

7. The apparatus of claim 1 wherein the power source is one or more batteries.

8. The apparatus of claim 7 wherein the power source is a single, 9V battery.

9. The apparatus of claim 7 that further includes a switch that activates the power source.

10. The apparatus of claim 1 wherein the body has apertures at the top and apertures at the bottom, the apertures for receiving fasteners.

11. The apparatus of claim 10 wherein the body has three apertures at the top and three apertures at the bottom.

12. The apparatus of claim 1 wherein the top cap has three openings, the body top has three apertures, and one of each of the three openings aligns with one of each of the three apertures.

13. The apparatus of claim 12 wherein a fastener is received through each of the three openings and retained in the corresponding aperture.

14. The apparatus of claim 13 wherein the fasteners are screws.

15. The apparatus of claim 1 wherein the motor is at least partially retained in a motor sleeve.

16. The apparatus of claim 1 wherein the body has a height, a portion above the center, and a portion below the center, and the motor is positioned in the body at the center or above the center.

17. The apparatus of claim 16 wherein the motor is positioned at least partially above the center.

18. The apparatus of claim 16 wherein the motor is positioned entirely above the center.

19. The apparatus of claim 7 that has a bottom in which the one or more batteries are positioned.

20. The apparatus of claim 19 wherein the bottom has a removable plate to replace the one or more batteries.

* * * * *